United States Patent [19]

Crain et al.

[11] Patent Number: 4,669,657

[45] Date of Patent: Jun. 2, 1987

[54] TOY TRAIN PLAY SETTING WITH DETACHABLE STORAGE BUILDING

[75] Inventors: Philip W. Crain, Rancho Palos Verdes; James D. Openshaw, Hermosa Beach, both of Calif.

[73] Assignee: Mattel, Inc., Hawthorne, Calif.

[21] Appl. No.: 773,146

[22] Filed: Sep. 6, 1985

[51] Int. Cl.[4] ..... A63H 19/36

[52] U.S. Cl. ..... 238/10 A; 238/10 E; 446/75

[58] Field of Search ..... 238/10 A, 10 E, 10 F, 238/10 R; 446/75, 85, 423, 446, 447, 476

[56] References Cited

U.S. PATENT DOCUMENTS

| | | | |
|---|---|---|---|
| D. 46,256 | 8/1914 | Lahiere | 21/114 |
| D. 180,441 | 6/1957 | Dian et al. | D34/15 |
| 1,914,116 | 12/1931 | Ford | 238/10 A |
| 2,004,915 | 6/1935 | Clark | 46/48 |
| 2,955,763 | 10/1957 | Shapin | 238/10 A |
| 3,205,617 | 9/1965 | Martin | 46/218 |
| 3,352,054 | 11/1967 | Glass et al. | 46/17 |
| 3,384,991 | 5/1968 | Einfalt | 46/202 |
| 3,579,904 | 5/1971 | Genin | 46/216 |
| 3,593,454 | 7/1971 | Einfalt | 446/423 |
| 4,161,081 | 7/1979 | Katzman et al. | 446/476 X |
| 4,349,983 | 9/1982 | Kilroy et al. | 238/10 A X |
| 4,558,867 | 12/1985 | Hippely | 446/75 X |

OTHER PUBLICATIONS

Märklin catalogue, Gebr. Märklin & Cie. GmbH, 1959, p. 44.

*Primary Examiner*—Robert B. Reeves
*Assistant Examiner*—Scott H. Werny
*Attorney, Agent, or Firm*—Ronald M. Goldman; Melvin A. Klein; Daniel F. Sullivan

[57] ABSTRACT

A toy train play setting having a landscape base structure molded in one piece, the upper surface having formed thereon a trackway, a depressed roadway portion, and upwardly extending wall portions of generally rectangular form for detachably receiving thereon a simulated building, which, when attached, form door like openings about a trackway section for passage therethrough of the train, and the building serves for storage of the train vehicles. The lower surface of the structure is provided with a channel portion, which in conjunction with the surface on which the play setting is positioned, forms a lower tunnel. A handle is provided for portability of the play setting.

2 Claims, 5 Drawing Figures

10
12
12a
12b
12c
12d
12e
12f
12g
14
16
18
20
22
24
26
28
30
30a
30b
34
36
38
40
42
48
50
5

TOY TRAIN PLAY SETTING WITH DETACHABLE STORAGE BUILDING

BACKGROUND OF THE INVENTION

The background of the invention will be discussed in two parts:

1. Field of the Invention

This invention relates to play settings for toy trains, and more particularly to a molded toy train landscape play setting with multi-leveled tunnels and provision for portability.

2. Description of the Prior Art

Toy trains, along with tracks, structures, play settings and accessory items therefor, have been a source of amusement for decades, particularly the types of toy train landscape layouts which provide some form of flexibility in play situations. Numerous structures for use with toy trains have been developed, with special attention to a track layout arrangement for use therewith.

One such early structure is shown and described in U.S. Pat. No. Des. 46,256, issued Aug. 11, 1914, to Lahiere, for a "Toy", such patent depicting a landscape arrangement with a vehicle road bed and a train track with structures and vegetation on the landscape.

A modular train track layout is shown and described in U.S. Pat. No. Des. 180,441, entitled "Model Train Track Support", issued to William Dian and Harvey Kramer, on June 11, 1957, the support being formed in four sections with hills and tunnels thereon with separable track sections spanning the junctions of the sections.

U.S. Pat. No. 2,004,915, is directed to another such toy train landscape, and is entitled "Toy Transportation System", such patent being issued to Clark on June 11, 1935, the system including a base with a roadway thereon for traversal of a vehicle thereover. The base is mounted on a support for rocking the base in different directions for enabling control of movement of the vehicle on the roadway.

U.S. Pat. No. 3,205,617, entitled "Gravity Toy Train", issued to Martin on Sept. 14, 1965, such patent disclosing a miniature landscape having an inclined circuitous track weaving in and out of tunnels for a toy train propelled by gravity.

Another structure for supporting toy trains is shown and described in U.S. Pat. No. 3,352,054, issued to Glass et al, on Nov. 14, 1967, such patent being entitled "Changeable Tile Layout Including Electrically Connectable Track", the layout including rectangular tiles having scenery formed thereon with an integrally formed roadbed section with the track fixed thereto. Metal eyelets are provided adjacent the edges of the tiles for electrical connection of the tracks on adjoining tiles.

Another such toy train support structure is shown in U.S. Pat. No. 3,384,991, issued May 28, 1968, to Einfalt for a "Toy Mountain Railroad", the patent disclosing a base structure formed of plastic or the like and having a track system in which two self-propelled toy vehicles are driven, partly by the power drive of the vehicles and partly by gravity.

U.S. Pat. No. 3,579,904, was issued to Genin, on May 25, 1971, and is entitled "Toy Railroad Assembly", the patent disclosing a structure formed of a plurality of square boards, each board having a depressed track section therein adapted to communicate with track sections on contiguous boards. The boards are provided with peg holes adapted to receive the supporting pegs of diversified scenic elements.

It is an object of the present invention to provide a new and improved toy train play setting.

It is another object of the present invention to provide a new and improved landscape toy train play setting having tunnels formed therein for passage of trains and other vehicles.

It is a further object of the present invention to provide a new and improved toy train play setting having a surface with a garage like structure thereon for storage of the toy trains therein.

It is a still further object of the present invention to provide a new and improved toy train play setting which includes handle means for portability.

SUMMARY OF THE INVENTION

The foregoing and other objects are accomplished by providing a toy train play setting having a landscape base structure molded in sheet-like thickness in one piece, the upper surface having formed thereon a trackway, a depressed roadway portion, and upwardly extending generally rectangular wall portions for detachably receiving thereon a simulated building configured to resemble a repair depot or the like. The lower surface thereof is provided with a channel portion, which in conjunction with the surface on which the play setting is positioned, forms a lower tunnel. The upper surface has a portion of the trackway terminating at an edge for interconnection with other track sections. The foundation and the depot, when attached, form door like openings about a trackway section for passage therethrough of the train. The depot is configured for storage of the trains, and the structure is provided with a handle for carrying of the play setting.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
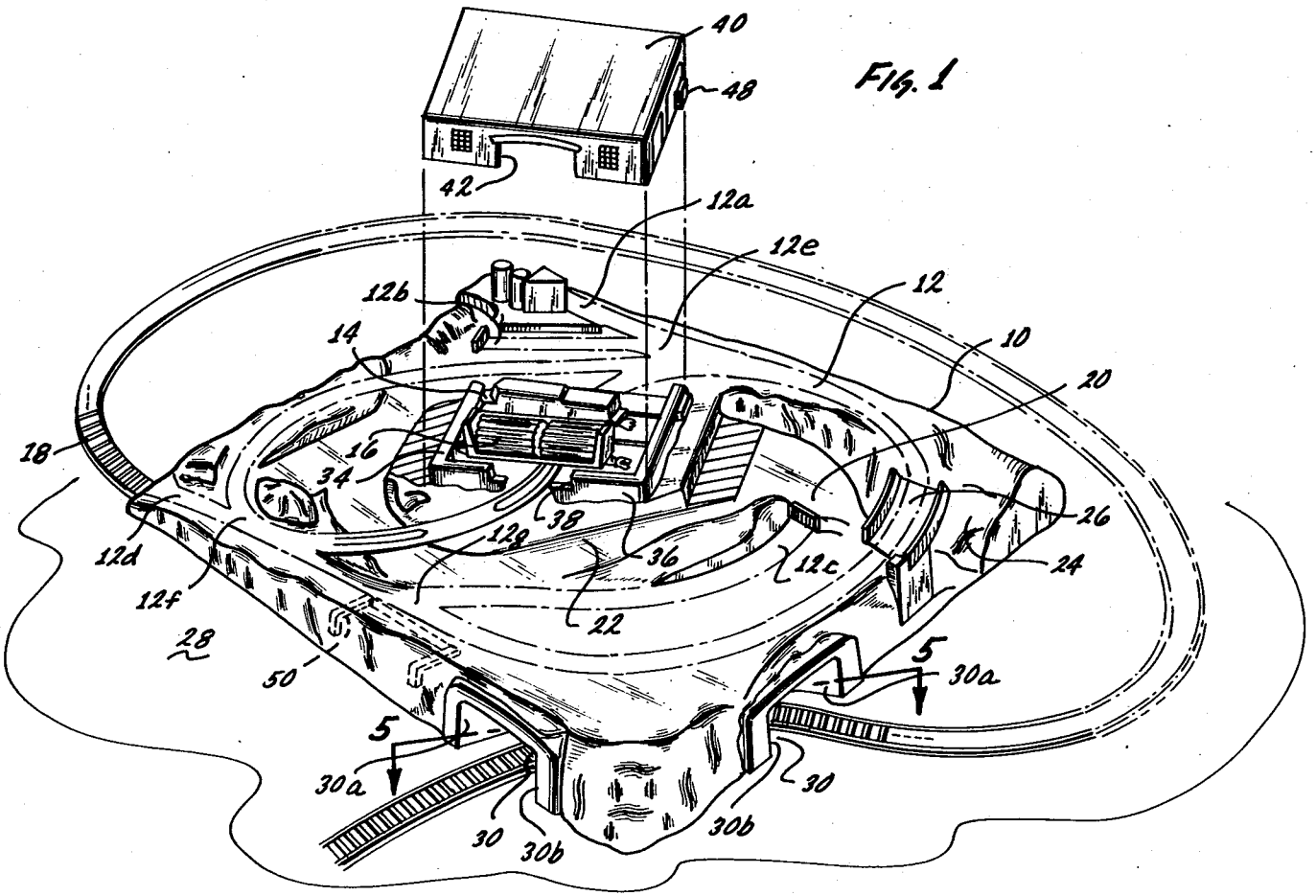
FIG. 1 is a perspective, partially exploded, view of the toy train play setting in accordance with the present invention.

Referring now to the drawings, and particularly to FIG. 1, there is shown a toy train play setting, having a unitary supporting base structure 10 formed of a plastic material, such as by molding, with varying levels of terrain and landscape details formed therein. The upper surface is formed with an integral trackway 12 configured and positioned for passage thereover of a train set including, for example, a locomotive 14 and a railroad car 16, which, in FIG. 1, are shown in the stored position. The locomotive 14 may be powered or unpowered. In either event the trackway 12 is formed as a generally continuous loop with track sidings 12*a*, 12*b*, 12*c*, and 12*d*, and track switch sections 12*e*, 12*f* and 12*g*.

In plan view, the base structure 10 is generally rectangular with the siding 12*d* terminating at one edge thereof for attachment to other separable track sections, generally designated 18. In addition to the trackway 12, the base structure 10 has molded in the upper surface thereof various roadway sections such as sections 20 and 22 on which toy cars, trucks or other vehicles may be placed. The upper surface is configured to provide a somewhat hilly terrain with different portions of the trackway 12 being at different elevations with sloped portions for facilitating movement of a train thereon, particularly if an unpowered toy train is used.

The roadway section 20 is formed between simulated cliffs 24 with a separate simulated bridge 26 spanning the gap, with the bridge 26 press fit into the gap. The bridge 26 has a track section formed in the upper surface thereof, and when spanning the gap between the cliffs 24, a vehicular tunnel is formed therebeneath.

Figure 5:
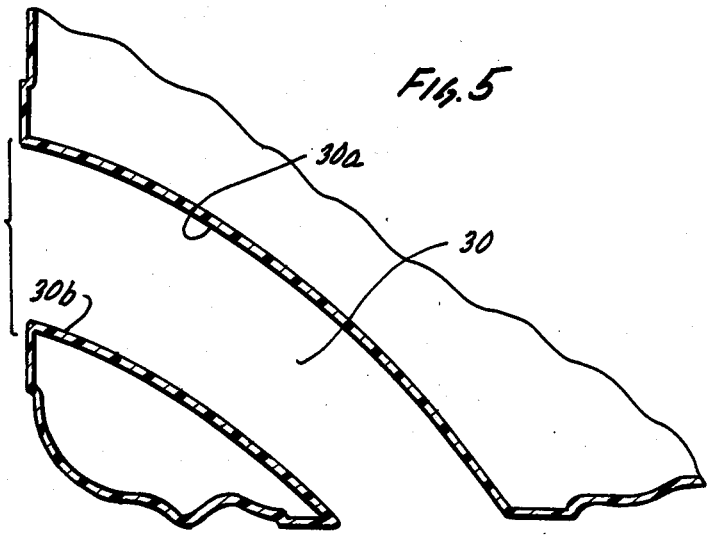
FIG. 5 is a cross-sectional view of a portion of the base structure of the toy train setting of FIG. 1 as viewed generally along line 5—5 thereof.

The undersurface of the base structure 10 has the edges thereof in generally planar alignment for positioning on a surface 28, such as a table or floor. The undersurface of the structure 10 is also formed with a channel 30 (see also FIG. 5)formed between sidewalls 30*a* and 30*b*, which, in cojunction with the supporting surface 28, forms a lower level tunnel through which the separable track sections 18 may be positioned for passage of the train therethrough from the siding 12*d* and then over the track sections 18.

Figure 2:
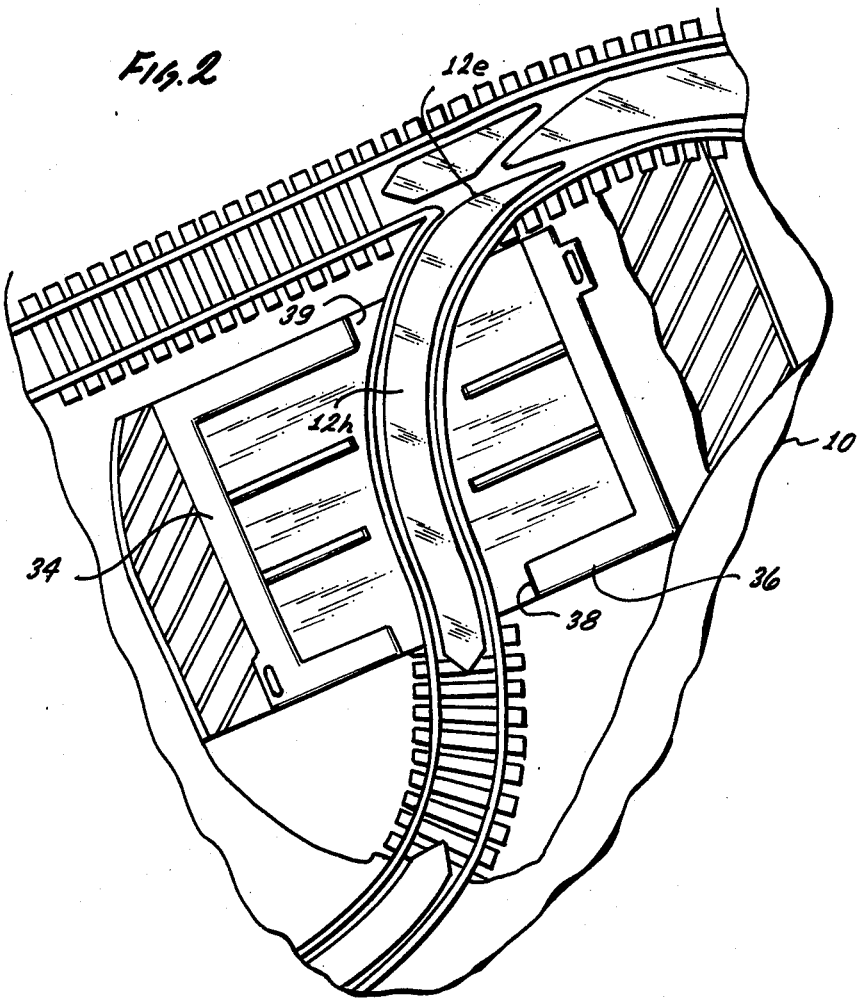
FIG. 2 is a partial plan view of a portion of the toy train play setting of FIG. 1 at the location of attachment of the building thereon.

At an intermediate location on the upper surface of the base structure 10, there is integrally formed a plurality of upwardly extending wall portions 34 and 36 which are dimensioned and arranged to form a generally rectangular configuration, in plan view, as shown in FIG. 2, with first and second gaps 38 and 39 formed on opposite sides with a track section 12*h* passing therethrough.

Figure 3:
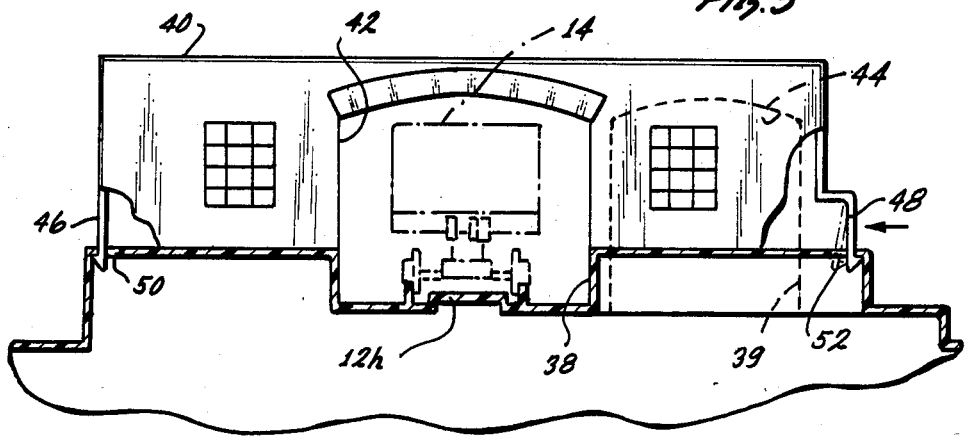
FIG. 3 is a front view, partially in cross-section and partially broken away to illustrate the interconnection of the base structure and building of the toy train setting of FIG. 1.

By reference to FIG. 3, as well as FIGS. 1 and 2, the upper edges of the wall portions 34 and 36 define a plane for receiving the lower edges of the walls of a simulated building 40, which is provided with door openings 42 and 44, which align with the gaps 38 and 39, respectively, of the wall portions 34 and 36 to define openings for passage therethrough of the toy trains 12 and 14. The building 40 is detachably secured to the base surface 10 atop the wall portions 34 and 36 by means of first and second depending tang members 46 and 48 formed in diagonally opposed corners of the building 40, the tang members 46 and 48 being positioned and dimensioned for engagement within slots 50 and 52 formed in the upper edges of the wall portions 34 and 36 in vertical aligment with the tangs 46 and 48, respectively. The tang members 46 and 48 are somewhat resilient and deformable as indicated by the dotted line at tang member 48 in FIG. 2, and may be bent to remove the building 40 from the base structure 10 for enabling storage of the trains 14 and 16 therein as shown in FIG. 1. For storage purposes, the locomotive 14 and car 16 are positioned generally transverse to the track section 12*h* passing through the building 40.

Figure 4:
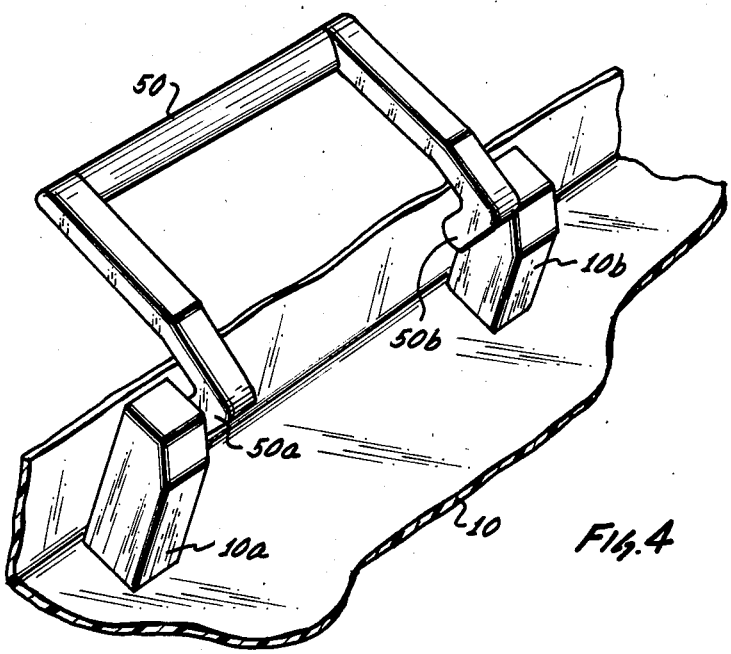
FIG. 4 is a partial perspective view of the handle assembly of the toy train setting of FIG. 1.

For portability, the base structure 10 is provided with handle means (see FIG. 4) including a generally U-shaped handle 50 (shown in dotted lines in FIG. 1) having the offset ends 50*a* and 50*b* thereof pivotably received within spaced hinge blocks 10*a* and 10*b*, respectively, formed in the undersurface of the base structure 10. The depiction in FIG. 4 shows the base structure 10 inverted, and by reference to FIG. 1, it can be seen that the handle 50 pivots into the hollow underside of the structure 10 when positioned on a supporting surface 28. For transportation, the handle 50 may be readily pivoted to an outer position for grasping and carrying of the structure 10 with the trains 14 and 16 stored within the building 40.

While there has been shown and described a preferred embodiment, it is to be understood that various other adaptations and modifications may be made within the spirit and scope of the invention.

We claim:

1. In a landscape play setting for use with toy train vehicles, the combination comprising:

a base structure molded from a sheetlike plastic material as a terrain in one piece and having formed on the upper surface thereof a trackway, and upwardly extending wall portions having gaps on opposing wall portions thereof with a section of said trackway passing through said gaps, the upper edges of said wall portions defining a common plane;

a channel portion formed on the lower surface of said structure for forming a tunnel in conjunction with a surface on which said play setting rests;

simulated building means having a periphery for enabling the lower edges of the walls thereof to be received in abutting relation with the upper edges of said wall portions, said building means having first and second door openings for alignment with said gaps for providing first and second openings about said section of said trackway for passage therethrough of a train;

means on said wall portions for detachably receiving said building means, said upper surface, said wall portions, and said building means being configured and dimensioned for providing storage for train vehicles within said building means in a direction generally transverse to said section of said trackway; and a handle member pivotably coupled to said base structure for pivoting from a position beneath said base structure to a position for gripping and carrying said setting.

2. The combination according to claim 1 wherein said trackway has a portion thereof terminating at an edge of said base structure for interconnection with other separable track sections.

* * * * *